US007695321B2

(12) United States Patent
Cayzac

(10) Patent No.: US 7,695,321 B2
(45) Date of Patent: Apr. 13, 2010

(54) SCREENED CONNECTOR FOR ELECTRICAL CONDUCTORS

(75) Inventor: Gaspard Cayzac, Margut (FR)

(73) Assignee: Amphenol-Air LB, Colombes (FR)

( * ) Notice: Subject to any disclaimer, the term of this patent is extended or adjusted under 35 U.S.C. 154(b) by 0 days.

(21) Appl. No.: 11/441,919

(22) Filed: May 26, 2006

(65) Prior Publication Data

US 2007/0032131 A1 Feb. 8, 2007

(30) Foreign Application Priority Data

May 27, 2005 (FR) ..... 05 05383

(51) Int. Cl.
*H01R 13/648* (2006.01)

(52) U.S. Cl. ..... 439/610

(58) Field of Classification Search ..... 439/610, 439/607, 660, 271, 587, 362; 361/818, 679
See application file for complete search history.

(56) References Cited

U.S. PATENT DOCUMENTS

| | | | | |
|---|---|---|---|---|
| 2,115,556 | A | 4/1938 | Maniscalco | |
| 2,575,912 | A | 11/1951 | Doyle | |
| 2,824,290 | A | 2/1958 | Archer et al. | |
| 3,125,395 | A | 3/1964 | Archer et al. | |
| 3,308,421 | A | 3/1967 | Joseph | |
| 3,477,061 | A | 11/1969 | Dean | |
| 3,478,302 | A | 11/1969 | Chirumbolo | |
| 3,594,698 | A | 7/1971 | Anhalt | |
| 3,638,165 | A | 1/1972 | Anhalt et al. | |
| 4,109,987 | A | 8/1978 | Bourdon et al. | |
| 4,349,241 | A * | 9/1982 | Juris et al. | 439/88 |
| 4,544,220 | A | 10/1985 | Aiello et al. | |
| 4,615,578 | A * | 10/1986 | Stadler et al. | 439/607 |
| 4,684,187 | A | 8/1987 | Rudy et al. | |
| 4,822,286 | A | 4/1989 | Bianca et al. | |
| 5,257,768 | A | 11/1993 | Juenemann et al. | |
| 5,437,563 | A | 8/1995 | Kihira et al. | |
| 5,437,564 | A * | 8/1995 | Lignelet | 439/701 |

(Continued)

FOREIGN PATENT DOCUMENTS

DE 10323616 8/2004

(Continued)

OTHER PUBLICATIONS

Search Report for co-pending French Application No. 0505383, mailed Dec. 22, 2005, 1 page.

(Continued)

*Primary Examiner*—Alexander Gilman
(74) *Attorney, Agent, or Firm*—Meyertons, Hood, Kivlin, Kowert & Goetzel, P.C.; Eric B. Meyertons

(57) ABSTRACT

This screened connector for electrical conductors includes paired connector assemblies, namely a first connector assembly and a second connector assembly, the connector assemblies including an insulating body made of a molded material incorporating respectively male and female contacts, for mechanical fastening and electrical connection of contact terminals provided at the ends of the conductors to be connected, and a screening case that surrounds the insulator body. Each screening case has the general shape of a hollow cylinder internally defining a continuous passage so that the insulator bodies are in contact with each other via a seal.

8 Claims, 4 Drawing Sheets

U.S. PATENT DOCUMENTS

| | | | | |
|---|---|---|---|---|
| 5,718,592 | A | 2/1998 | Hosler, Sr. et al. | |
| 5,975,956 | A * | 11/1999 | Huguenet | 439/607 |
| 6,000,966 | A | 12/1999 | Dechanteloup et al. | |
| 6,042,428 | A | 3/2000 | Espiritu et al. | |
| 6,059,600 | A | 5/2000 | Vanbesien | |
| 6,065,999 | A | 5/2000 | Radliff | |
| 6,135,818 | A * | 10/2000 | Lang et al. | 439/610 |
| 6,196,873 | B1 | 3/2001 | Murakami et al. | |
| 6,398,585 | B1 | 6/2002 | Fukuda | |
| 6,478,631 | B1 * | 11/2002 | Dutton et al. | 439/707 |
| 6,523,790 | B2 | 2/2003 | Sentpali et al. | |
| 6,582,244 | B2 * | 6/2003 | Fogg et al. | 439/362 |
| 6,632,107 | B1 | 10/2003 | Vanbesien | |
| 6,705,894 | B1 * | 3/2004 | Comerci et al. | 439/607 |
| 6,902,138 | B2 | 6/2005 | Vantouroux | |
| 6,926,562 | B1 * | 8/2005 | Wu | 439/660 |
| 7,033,214 | B2 | 4/2006 | Vantouroux | |
| 7,326,090 | B2 | 2/2008 | Cayzac | |
| 2004/0224552 | A1 | 11/2004 | Hagmann et al. | |

FOREIGN PATENT DOCUMENTS

| | | |
|---|---|---|
| EP | 0237383 | 9/1987 |
| EP | 0416769 | 3/1991 |
| EP | 0866521 | 9/1998 |
| FR | 2742264 | 6/1997 |
| GB | 2282920 | 10/1993 |

OTHER PUBLICATIONS

European Search Report for co-pending European Application Publication No. EP06290890, 1 page.
Search Report for French Application No. 055383, mailed Dec. 22, 2005, 1 page.

* cited by examiner

SCREENED CONNECTOR FOR ELECTRICAL CONDUCTORS

BACKGROUND OF THE INVENTION

1. Field of the Invention

The present invention relates to a screened connector for electrical conductors.

2. Description of the Relevant Art

Such connectors are conventionally used for electrically connecting conductors to be connected.

The connectors of this type generally include two paired connector assemblies, which are fastened together, the connector assemblies each comprising an insulator body made of molded material incorporating respectively male and female contacts, for mechanical fastening and electrical connection of contact terminals provided at the ends of the conductors to be connected, and a screening case that surrounds the insulator body.

Such connectors are generally used in transport vehicles, in particular in aircraft, for supplying power to onboard electrical or electronic components, or for exchanging data between these components.

For such applications, the use of composite materials tends to be commonplace. Such is in particular the case of connectors often made of plastic, thereby giving them high mechanical strength for a relatively low weight. However, contrary to connectors made from metallic materials, connectors made of composite material exhibit an electrical discontinuity and therefore an interruption in the screening of the cases in their connection region.

This is the reason why, in this type of screened connector, metal cases for the connector assemblies have facing end portions in the form of a skirt, one being superposed on the other, in order to produce a continuous screen between the first and second connector assemblies. Connection is provided by resilient continuity contacts. Furthermore, the cases are shaped so as to surround the insulator bodies at their radial peripheral surface, but also axially, on their end surface.

Composite cases incorporate the one-piece insulator body. It therefore becomes relatively tricky to metallize the constituent material of the casings incorporating the one-piece insulator body without short-circuiting the contacts, so that these casings have to be produced separately. The screening cases are also specific to a single type of connector, either a cylindrical or a rectangular connector.

SUMMARY OF THE INVENTION

It is desirable, therefore to produce a screen for a connector for electrical conductors that is capable of being fitted to a large number of connectors of different types made of composite materials.

Described herein is a screened connector of the aforementioned type, in which each screening case has the general shape of a hollow cylinder or parallelepiped internally defining a continuous passage so that the insulator bodies are in contact with each other via a seal.

Thus, thanks to the cases being produced in the form of an envelope surrounding the bodies, in the absence of any part to be interposed between the facing faces of the insulator bodies, the screening cases may be fitted to a large number of existing connectors, in so far as no component disturbs the geometry of the internal assembly of the connector.

According to another embodiment, the end portion forming a skirt of at least one of the cases includes at least one bump that comes into contact with the corresponding end portion of the other case and making it possible to ensure continuity.

In this embodiment, the seal includes a first face that bears against the insulator body of one of the connector assemblies and an opposed second face provided with a peripheral bead that bears against the end edge of the screening case of the other connector assembly.

In this case, the second face of the seal may further be provided with projecting sealing lips, each being inserted into a housing into which a passage of the insulator body opens and in which a mechanical fastening/electrical connection contact is held in place.

According to yet another embodiment, each connector assembly further includes a sealing insulator surmounted on one free end face of the insulator body of said connector assembly and including sealed passages for the conductors.

The cases may then extend as far as the respective sealing insulators so as to at least partly surround said insulators.

According to yet another embodiment, the facing surfaces of the cases and of the bodies include irregularities capable of ensuring that the bodies are held in place in the respective cases.

Furthermore, the connector includes an accessory in the form of a screening shell provided with snap-fastening means intended to cooperate with complementary snap-fastening means provided in projections of said cases and including generally cylindrical projecting ducts, each intended to surround a conductor bundle.

In one embodiment, the shell consists of two complementary half-shells provided with complementary snap-fastening means.

Advantageously, the cases are provided respectively with first and second mutual fastening means including polarizing means that permit cooperation of the fastening means in only one defined position of the cases.

For example, the polarizing means include a male polarizer, including a bush provided with a projecting tooth, and a female polarizer, provided with a housing for receiving the projecting tooth aligned with the tooth in said defined position of the cases.

BRIEF DESCRIPTION OF THE DRAWINGS

Other objects, features and advantages of the invention will become apparent on reading the following description, given solely by way of non-limiting example and with reference to the appended drawings in which.

Figure 1:
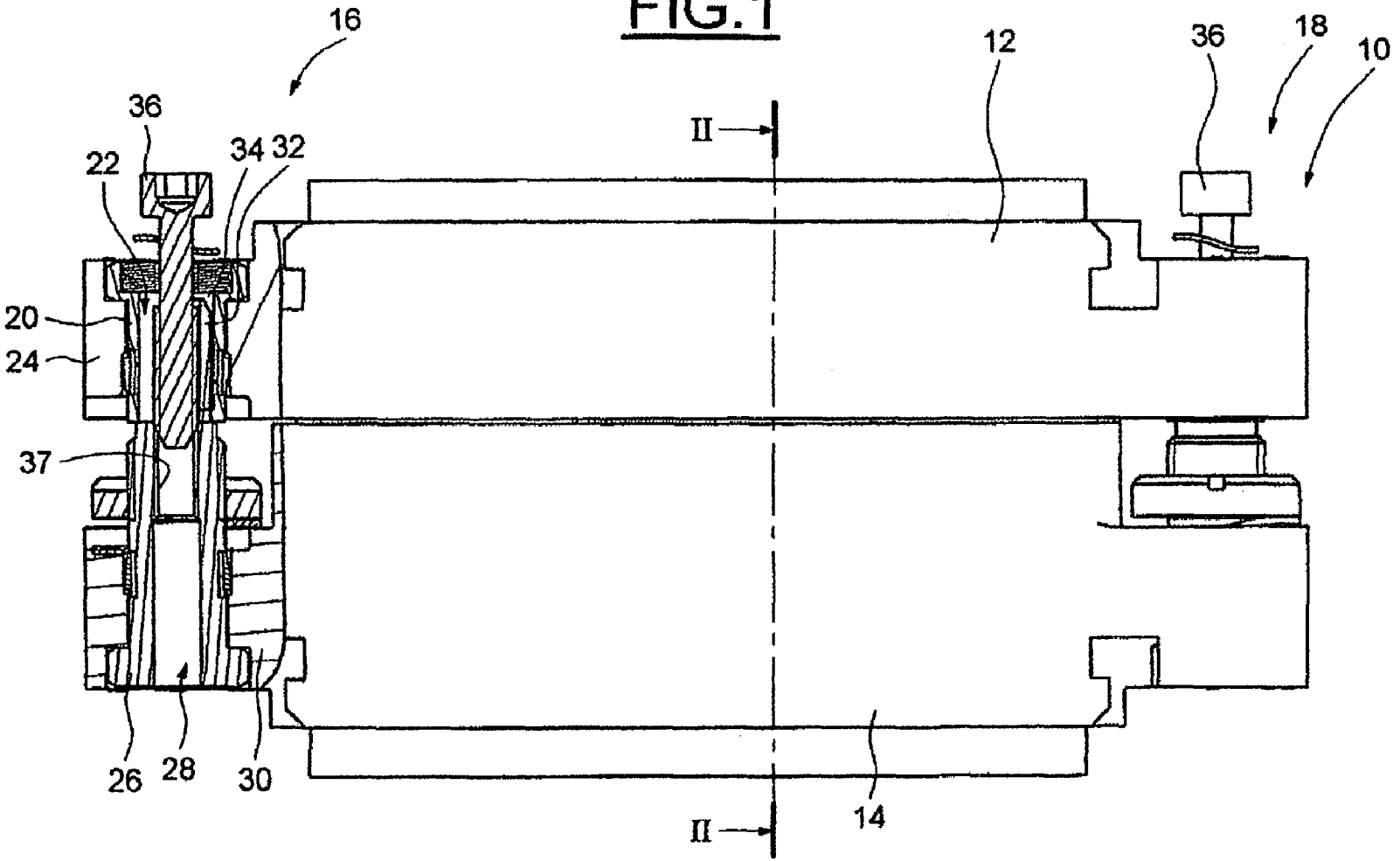
FIG. 1 is an end view, with partial cut-away, of a connector according to an embodiment.

While the invention is susceptible to various modifications and alternative forms, specific embodiments thereof are shown by way of example in the drawings and will herein be described in detail. It should be understood, however, that the drawing and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

FIG. 1 shows a side view of a connector according an embodiment, denoted by the general numerical reference 10, in an assumed vertical position.

As may be seen in this figure, the connector 10 includes two connector assemblies, namely a front or upper connector assembly 12 and a rear or lower connector assembly 14.

Each connector assembly 12 and 14 is intended for the mechanical fastening and electrical connection of a conductor bundle and for establishing electrical connection of conductors to be connected to the connector assembly 12 on the one hand, and to the connector assembly 14 on the other, while ensuring electromagnetic screening of the connection.

The first and second connector assemblies 12 and 14 are fastened to each other by means of first and second mutual fastening means 16 and 18. To avoid any risk of erroneous connection, the fastening means are each equipped with polarizing means for permitting the connector assemblies 12 and 14 to be fastened together only in a predefined position of the connector assemblies.

For this purpose, each locking means 16 and 18 includes a first bush 20 held in place in a bore 22 provided in an extension of the first connector assembly 12, and a second bush 26 axially aligned with respect to the first bush 20 and held in place in a bore 28 provided in an extension 30 of the second connector assembly 14.

The first bush 20 constitutes a female polarizer, while the second bush 26 constitutes a male polarizer.

Specifically, the second bush 26 includes an axial tooth 32 and the first bush 20 includes a slot 34 which is aligned with the tooth 32 when the first and second connector assemblies 12 and 14 are mutually in a position in which they have to be fastened to each other in order to ensure electrical connection of the conductors to which they are fastened.

In this position, a screw 36 is screwed into an internal thread 37 provided in the bush 26.

Figure 2:
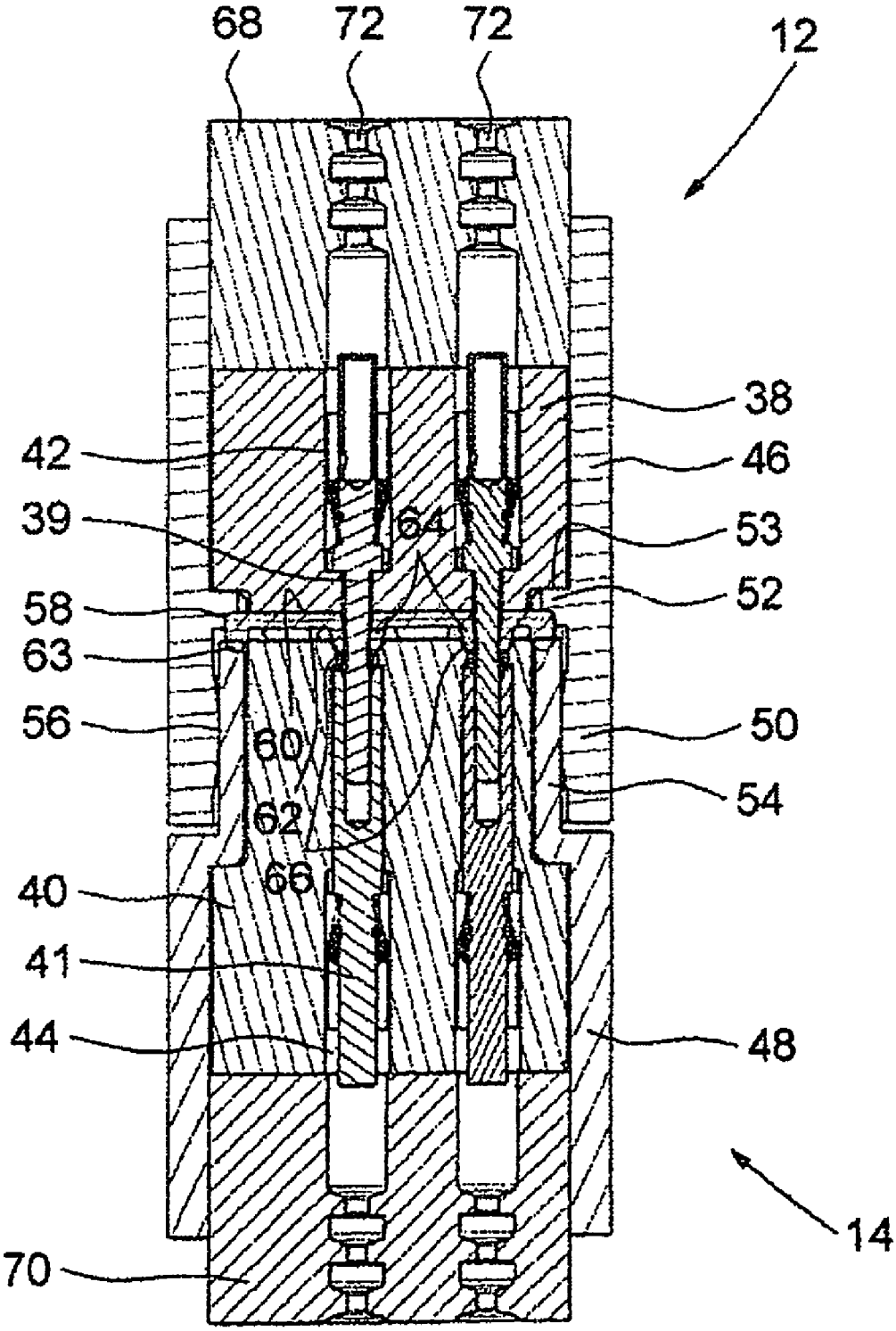
FIG. 2 is a sectional view, on a larger scale, on the line II-II of the connector of FIG. 1.

Referring now to FIG. 2, each connector assembly 12 and 14 includes an insulator body 38 and 40 made by molding a plastic. The insulator bodies 38 and 40 are each generally parallelepipedal and provided with passages, such as 42 and 44, in which paired, complementary male and female, contacts, such as 39 and 41, are placed, said contacts being intended to receive contact terminals (not shown) provided on the ends of the conductors to be connected.

Thus, one of the insulator bodies, namely the insulator body denoted by the reference 38, is provided with male contacts 39 constituting pins that extend so as to project towards the insulator body 40 in order to be inserted into the corresponding female contacts 41.

The insulator bodies 38 and 40 are each placed in a case or socket, respectively 46 and 48, made of a metallic material or advantageously a metallized composite material, intended to receive, by shape complementarity, one of the insulator bodies. For this purpose, the insulator bodies 38 and 40 are provided on the outside with embossments that constitute shape irregularities, allowing the bodies to be effectively retained in the cases 46 and 48.

One of the cases, namely the case denoted by the numerical reference 46, constitutes for example a fixed socket. It has a hollow cylindrical shape and includes an axial cylindrical extension 50 forming a skirt that extends beyond the end face of the insulator body 38 that it surrounds. However, it includes, on the inside, a localized sectional narrowing 52, which constitutes a seat on which an annular shoulder provided on the end face of the insulator body 38 bears.

With regard to the screening case 48 of the other connector assembly 14, this also has the shape of a hollow cylinder and includes an end skirt 54 which surrounds that end region of the insulator body 40 which is turned towards the first connector assembly 12. However, the screening case 48 has, in this region, a sectional narrowing such that the skirt 54 has an outside diameter slightly smaller than the inside diameter of the skirt 50 of the first case 46, so as to allow the second skirt 54 to be inserted into the first skirt 50.

To improve the assembly operation, the internal peripheral surface of the skirt 50 of the skirt 54 of the second case bears.

As may be seen in FIG. 2, after the cases have been fitted together, because of the hollow cylindrical shape of the cases, the facing end faces of the insulator bodies 38 and 40 may be brought into contact with each other via a seal 58.

The seal 58 is generally rectangular and has two mutually opposed large faces 60 and 62. The first large face 60 bears against the free end face of the insulator body 38 of the first connector assembly 12 and against the shoulder 52 of the screening case 46, while the other large face 62 is provided with a peripheral bead 63 which bears against the free end edge of the screening case 54 of the second connector assembly 14 and with a set of lips 64 that are inserted, in the assembled state, into housings 66 provided at the end of the body 40, in the extension of the passages 44 into which the female contacts 41 are inserted.

As may be seen in FIG. 2, the respective front and rear ends of the screening cases 46 and 48 extend beyond the respective front and rear ends of the insulator bodies 38 and 40. In the region of connection of the male and female contacts 42 and 44, the skirts 50 and 54 overlap and are in tight contact thanks to the use of the bumps 56. Therefore effective screening of the entire region of connection of the male and female contacts is obtained.

The sealing is supplemented, at the front and rear ends, by sealing insulators 68 and 70 that are formed by overmolding and include passages, such as 72, aligned with the respective male and female contacts for passage of the conductors.

Figure 3:
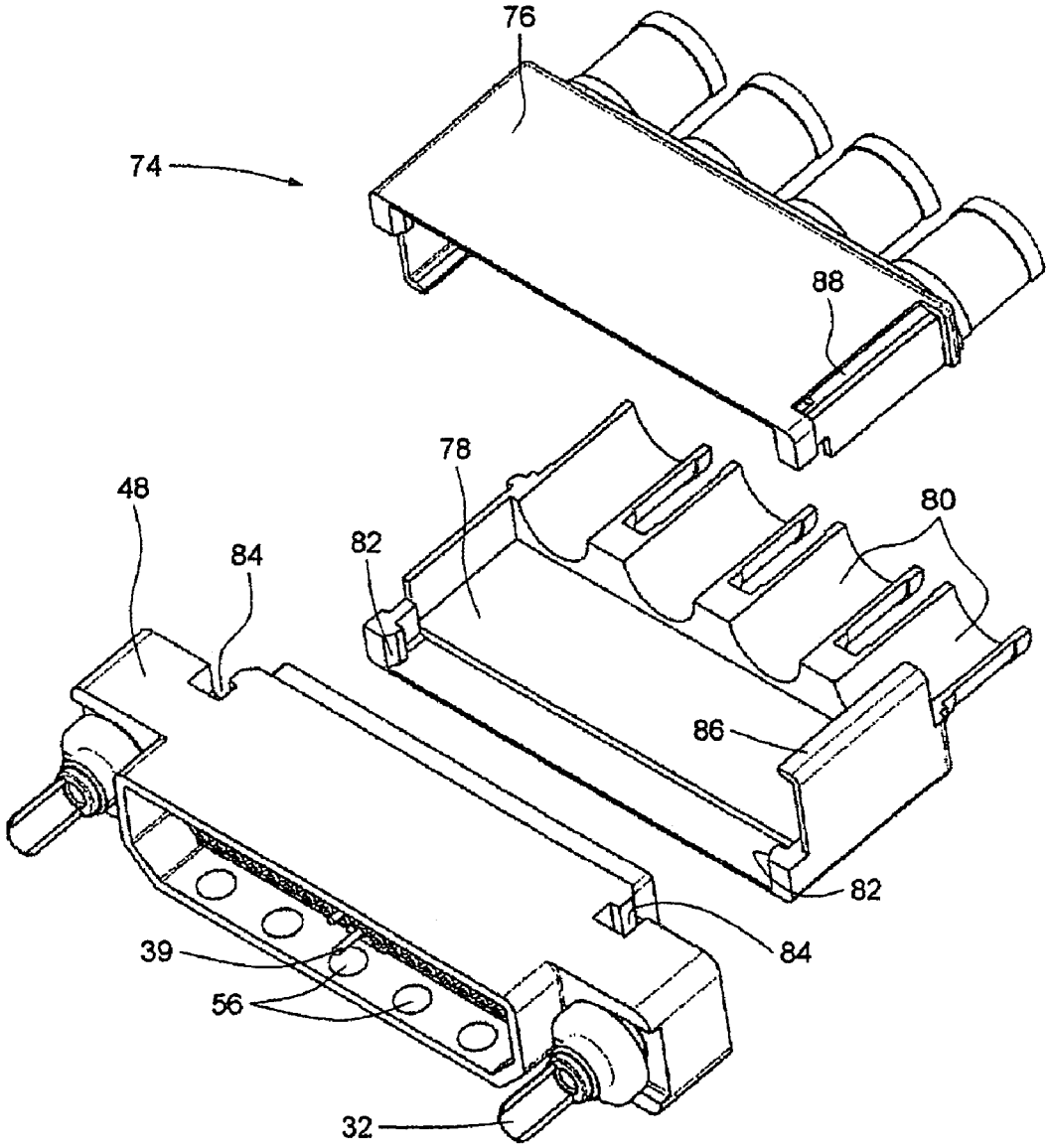
FIG. 3 is a perspective view of a connector assembly of the connector of FIG. 1 during assembly.
Figure 4:
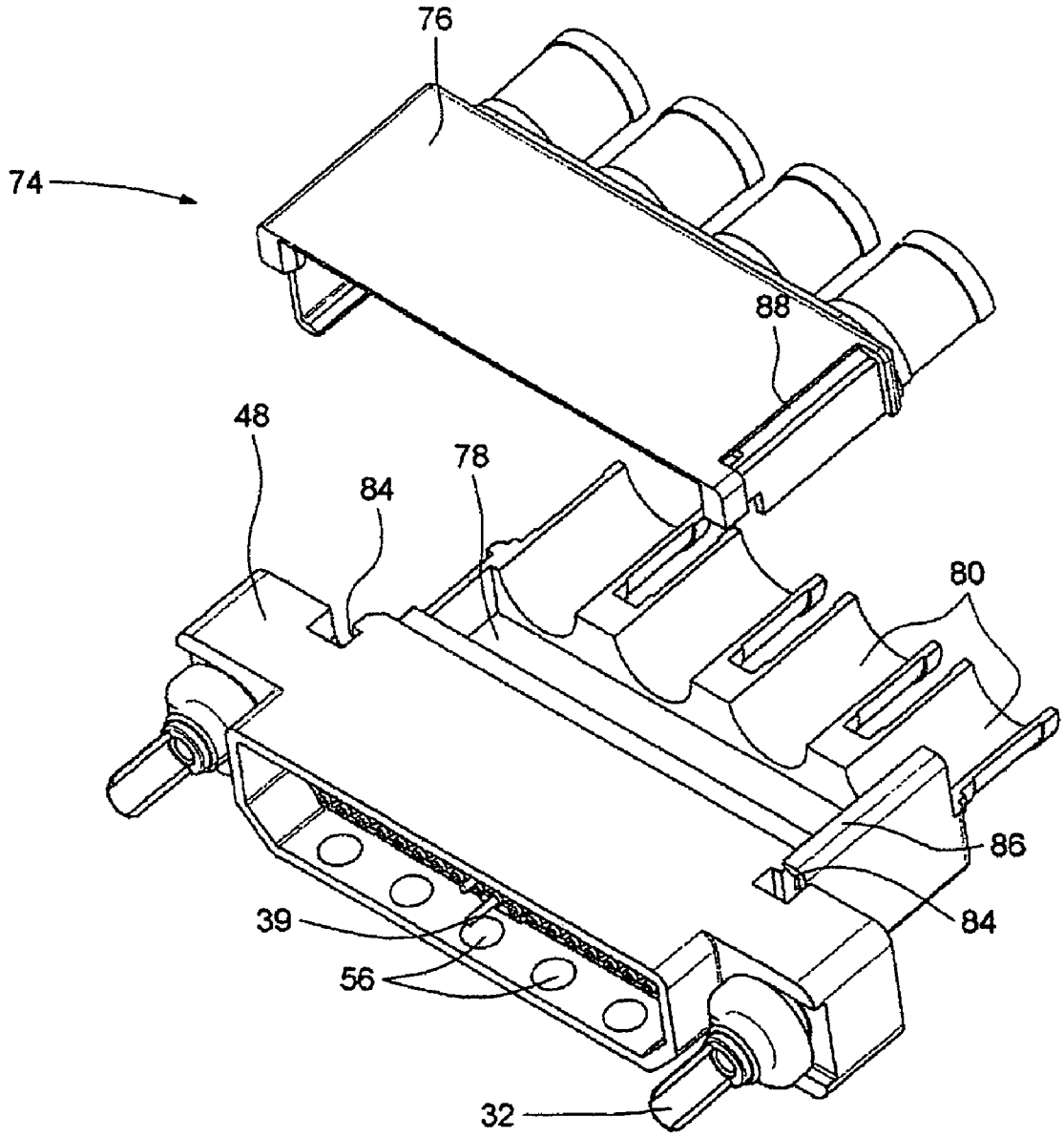
FIG. 4 illustrates another perspective view of the connector assembly of FIG. 3, at another stage in its assembly.

As may be seen in FIGS. 3 and 4, in this region, the screening is achieved by means of a shell 74 formed by the association of two complementary half-shells 76 and 78 that are fitted by snap-fastening onto the case, for example the case 48. Each half-shell includes a body made of a metallic material or a composite and includes a semicylindrical extension, such as 80, in order to form, in the assembled state, a set of ducts that respectively surround the end regions of the conductors to be connected.

Each half-shell 76 and 78 includes two opposed snap-fastening teeth, such as 82, each being snap-fastened into housings 84 provided for this purpose in the corresponding screening case.

Likewise, each half-shell is provided with a snap-fastening hook, such as 86, which snap-fastens into a housing 88 provided for this purpose in the other half-shell.

To produce the connector that has just been described, it is necessary firstly to form, by molding or machining, the screening cases. Produced separately, by molding, are the insulator bodies 38 and 40, with their external embossing, providing passages for the male and female contacts. The insulator bodies are then inserted into the cases. Next, the seal 58 is formed, by overmolding, on one of the insulator bodies, while providing the passages for the conductors. The contacts are then inserted into passages provided for this purpose in the insulator bodies.

After the conductors have been connected, it is simply necessary, as shown in FIG. 4, to snap-fasten one of the half-shells onto a corresponding connector assembly. The other half-shell is then clipped on, in order to form ducts surrounding the end regions of the conductors. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description to the invention. Changes may be made in the elements described herein without departing from the spirit and scope of the invention as described in the following claims. In addition, it is to be understood that features described herein independently may, in certain embodiments, be combined.

What is claimed is:

1. Screened connector for electrical conductors, comprising paired connector assemblies, namely a first connector assembly and a second connector assembly, the connector assemblies comprising an insulator body made of molded material incorporating male and female contacts respectively, for mechanical fastening and electrical connection of contact terminals provided at the ends of the conductors to be connected, and a screening case that surrounds the insulator body, the screening cases of the connector assemblies having, respectively, facing end portions in the form of a skirt, one being superposed on the other, in order to produce a continuous screen between the first and second connector assemblies, wherein the screening cases are provided with a first and second mutual fastening means, wherein each screening case has the general shape of a hollow cylinder internally defining a continuous passage so that the insulator bodies are in contact with each other via a generally rectangular seal; wherein the end skirt of at least one of the screening cases includes at least one bump that comes into contact with the corresponding end skirt of the other case; wherein the seal comprises a first face and a second opposed face, wherein the first face bears against the insulator body of one of the connector assemblies, and wherein the second face comprises a peripheral bead that bears against the end edge of the screening case of the other connector assembly and projecting sealing lips, each being inserted into a portion of the opposed insulator body and in which a mechanical fastening/electrical connection contact is held in place.

2. Connector according to claim 1, wherein each connector assembly further includes a sealing insulator surmounted on one free end face of the insulator body of said connector assembly and comprising passages for the conductors.

3. Connector according to claim 2, wherein the cases extend as far as the respective sealing insulators so as to at least partly surround said insulators.

4. Connector according to claim 1, wherein the facing surfaces of the cases and of the bodies include irregularities capable of ensuring that the bodies are held in place in the respective cases.

5. Connector according to claim 1, further comprising a screening shell provided with snap-fastening means intended to cooperate with complementary snap-fastening means provided in one of said cases and comprising generally cylindrical projecting ducts each intended to surround a conductor bundle.

6. Connector according to claim 5, wherein the shell consists of two complementary half-shells provided with complementary snap-fastening means.

7. Connector according to claim 1, wherein the cases are provided respectively with first and second mutual fastening means comprising polarizing means that permit cooperation of the fastening means in only one defined position of the cases.

8. Connector according to claim 7, wherein the polarizing means comprise a male polarizer, comprising a bush provided with a projecting tooth, and a female polarizer, provided with a housing for receiving the projecting tooth aligned with the tooth in said defined position of the cases.

* * * * *